US011443727B2

(12) United States Patent
Zollner

(10) Patent No.: US 11,443,727 B2
(45) Date of Patent: Sep. 13, 2022

(54) SYNCHRONIZED MULTICHANNEL LOOPBACK WITHIN EMBEDDED ARCHITECTURES

(71) Applicant: Harman Becker Automotive Systems GmbH, Karlsbad (DE)

(72) Inventor: Juergen Heinrich Zollner, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 95 days.

(21) Appl. No.: 16/773,474

(22) Filed: Jan. 27, 2020

(65) Prior Publication Data

US 2020/0251085 A1 Aug. 6, 2020

Related U.S. Application Data

(60) Provisional application No. 62/799,338, filed on Jan. 31, 2019.

(51) Int. Cl.
*G10K 11/178* (2006.01)

(52) U.S. Cl.
CPC .. *G10K 11/17823* (2018.01); *G10K 11/17873* (2018.01); *G10K 2210/3012* (2013.01); *G10K 2210/505* (2013.01)

(58) Field of Classification Search
CPC ..... G10K 11/17823; G10K 11/17873; G10K 2210/3012; G10K 2210/505
USPC ..... 381/71.1
See application file for complete search history.

(56) References Cited

U.S. PATENT DOCUMENTS 10,013,995 B1 * 7/2018 Lashkari ..... H04M 9/082
2016/0085348 A1 * 3/2016 Krause ..... G06F 3/038 345/173
2016/0196817 A1 * 7/2016 Mortensen ..... G10K 11/17823 381/71.8

FOREIGN PATENT DOCUMENTS

WO 2018208721 A1 11/2018

OTHER PUBLICATIONS

Freiberger, K. et al. ("Multi-Channel Noise/Echo Reduction in PulseAudio on Embedded Linux", Proceedings of the Linux Audio Conference 2013, May 9, 2013, 8 pgs.) (Year: 2013).*
European Search Report for Application No. 20154913.6, dated May 13, 2020, 9 pgs.
Freiberger, K. et al., "Multi-Channel Noise/Echo Reduction in PulseAudio on Embedded Linux", Proceedings of the Linux Audio Conference 2013, May 9, 2013, 8 pgs.
(Continued)

*Primary Examiner* — Vivian C Chin
*Assistant Examiner* — Douglas J Suthers
(74) *Attorney, Agent, or Firm* — Brooks Kushman P.C.

(57) ABSTRACT

In at least one embodiment, an embedded Linux system is provided. The Linux system includes a memory, a system on a chip (SoC) device, and a first circuit. The SoC device includes the memory and is programmed to process at least a reference signal indicative of undesired audio content and a measured signal indicative of measured audio data in a listening environment. The first circuit is programmed to receive the reference signal and the measured signal. The first circuit is further programmed to merge the reference signal with the measured signal to provide a combined system input to the SoC device to prevent temporal misalignment between the reference signal and the measured signal caused by one or more software layers of the Linux system.

20 Claims, 4 Drawing Sheets

(56) References Cited

OTHER PUBLICATIONS

Soejima, K. et al., "Building Audio and Visual Home Appliances on Linux", Applications and the Internet Workshops, Jan. 28, 2002, 6 pgs.
European Office Action for EP Application No. 20154913.6 filed Jan. 31, 2020, dated May 11, 2022, 4 pgs.

* cited by examiner

SYNCHRONIZED MULTICHANNEL LOOPBACK WITHIN EMBEDDED ARCHITECTURES

CROSS-REFERENCE TO RELATED APPLICATIONS

This application claims the benefit of U.S. provisional application Ser. No. 62/799,338 filed Jan. 31, 2019, the disclosure of which is hereby incorporated in its entirety by reference herein.

TECHNICAL FIELD

Aspects disclosed herein generally related to a synchronized multichannel loopback with an embedded architecture. These aspects and others will be discussed in more detail below.

BACKGROUND

Often times, processing in embedded systems (e.g. in a Linux operating system) is not in real-time, as buffers that are applied to a data system are not constant. Such buffers may change over time due to memory usage and system load. This behavior makes those popular and general-purpose System on a Chip (SoC) systems, widely used in mobile-phones, hardly usable for advanced algorithms such as, for example, acoustic echo cancellation (AEC) algorithms. This condition may also increase the need for expensive companion-chips.

SUMMARY

In at least one embodiment, an embedded Linux system is provided. The Linux system includes a memory, a system on a chip (SoC) device, and a first circuit. The SoC device includes the memory and is programmed to process at least a reference signal indicative of undesired audio content and a measured signal indicative of measured audio data in a listening environment. The first circuit is programmed to receive the reference signal and the measured signal. The first circuit is further programmed to merge the reference signal with the measured signal to provide a combined system input to the SoC device to prevent temporal misalignment between the reference signal and the measured signal caused by one or more software layers of the Linux system.

In at least another embodiment, a computer-program product embodied in a non-transitory computer readable medium that is programmed to prevent temporal misalignment between a reference signal and a measured signal for an embedded Linux system is provided. The computer-program product includes instructions to receive the reference signal indicative of undesired audio content and to receive the measured signal indicative of measured audio data in a listening environment. The computer-program product includes instructions to process the reference signal and the measured signal at a system on a chip (SoC) device and to merge the reference signal with the measured signal to provide a combined system data stream to the SoC device to prevent temporal misalignment between the reference signal and the measured signal caused by one or more software layers of the Linux system.

In at least another embodiment, a computer-program product embodied in a non-transitory computer readable medium that is programmed to prevent temporal misalignment between a reference signal and a measured signal for an embedded Linux system. The computer-program product comprising instructions to receive the reference signal indicative of output data for an adaptive control system. The computer-program product comprising instructions to process the reference signal and the measured signal at a system on a chip (SoC) device and to merge the reference signal with the measured signal to provide a combined system data stream to the SoC device to prevent temporal misalignment between the reference signal and the measured signal caused by one or more software layers of the Linux system.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
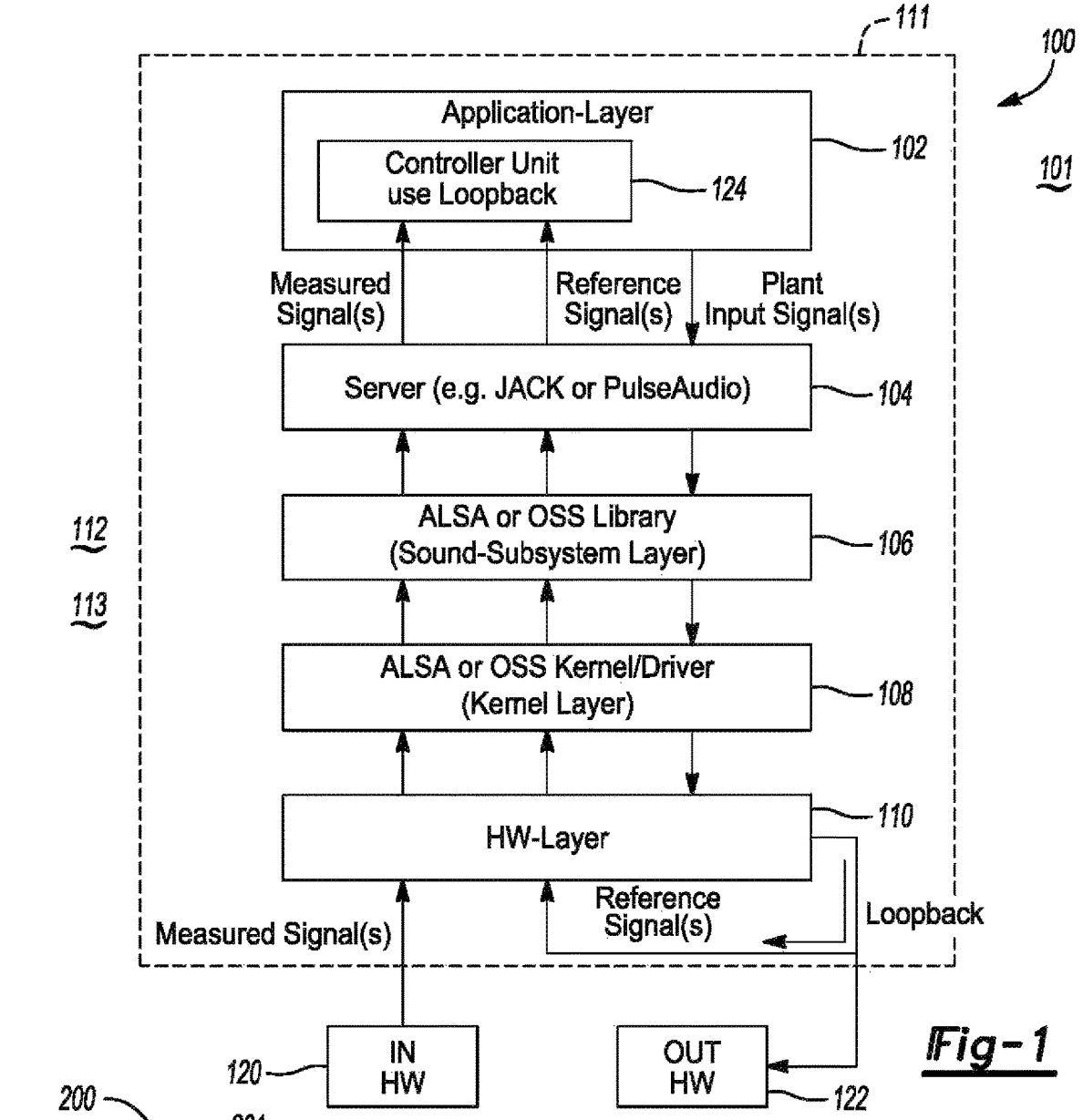
FIG. 1 depicts an example of an embedded adaptive control system.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that various electrical devices such as servers, controllers, and clients, etc. as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, these electrical devices utilize one or more microprocessors to execute a computer-program that is embodied in a non-transitory computer readable medium that is programmed to perform any number of the functions as disclosed. Further, the various electrical devices as provided herein include a housing and various numbers of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The electrical devices also include hardware-based inputs and outputs for receiving and transmitting data, respectively from and to other hardware-based devices as discussed herein.

Embodiments disclosed herein generally provide, among other things, a synchronized reference and measured embedded input signal architecture that may be used in connection with, for example, a LINUX operating system that enables the feasibility of many advanced algorithms. The architecture may be reliable and implemented for any number of adaptive control strategies. The Linux operating system may be used for any number of audio processing devices. For example, the architecture may utilize a synchronized reference and measured signals in connection with, but not limited to, for example, an Acoustic Echo Canceler or Cancellation (AEC) application, an active noise cancellation (ANC) system, any other suitable audio-based application or in general any control application which requires relative synchronized reference and measurement signals. The depicted enhancement (or architecture) may utilize a signal conditioning circuit that may be simple and yield a low-cost method that provides a relative synchronized design between reference and measured signals while the end-to-end latency may change dynamically. It is recognized that the embodiments as set forth herein may be applied to any system, not including an audio system whereby it is desired to achieve a control target by, for example, to minimize an error utilizing the relative synchronized reference and measured signals.

FIG. 1 depicts an example of an embedded adaptive control system 100. The adaptive control system 100 may be implemented, for example, in an embedded Linux Operating System (OS) 101. It is recognized that the system 100 may include a Linux kernel (e.g., a core of the OS) and related supporting tools and libraries. The system 100 generally includes an application layer 102, a server (or server layer) 104, a sound sub-system layer 106 or for example, an Advanced Linux Sound Architecture (ALSA) library layer 106 or an Open Sound System (OSS) library layer 106, a kernel (or driver) layer (e.g., ALSA kernel/driver or OSS kernel/driver) 108, and a hardware layer 110. The application layer 102, the server 104, the sound sub-system layer 106, the kernel layer 108, and the hardware layer 110 may form at least a System on a Chip (SoC) device 111. The SoC device 111 may be an integrated circuit that integrates all associated components therein. It is recognized that the SoC device 111 may include a central processing unit (CPU), memory 113, input/output ports, and/or secondary storage that may be packaged on a single substrate or microchip. The SoC device 111 may also include digital, analog, and/or mixed-signal processing devices. The SoC device 111 may be part of the Linux embedded system.

It is recognized that the system 100 further includes at least one controller 112 (hereafter the controller 112) for executing instructions to perform any and all of the tasks performed by the application layer 102, the server layer 104, the sound sub-system layer 106 and the kernel (or driver) layer 108. In addition, the controller 112 may interface with the hardware layer 110 to process data as received from the hardware layer 110 or to transmit data to the hardware layer 110.

Figure 2:
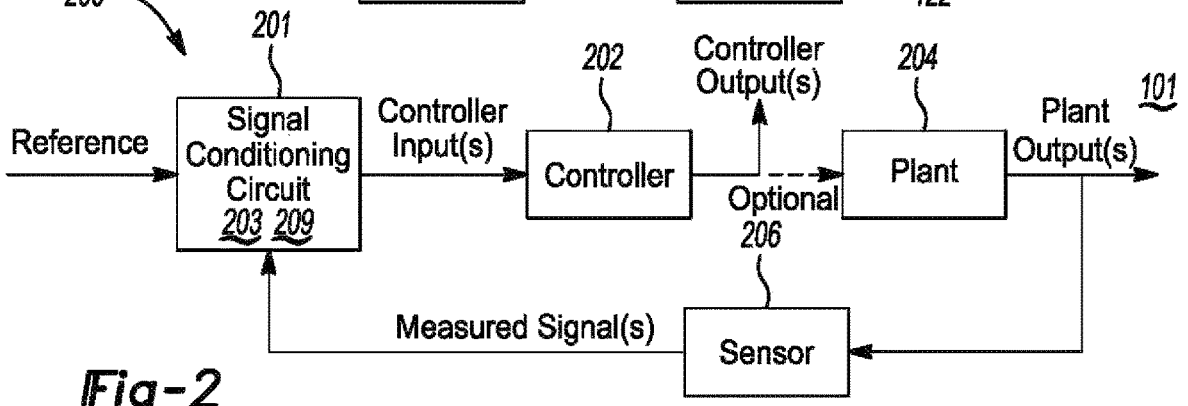
FIG. 2 depicts a high-level implementation of closed loop control implementation in accordance to one embodiment.

It is recognized that the control system 100 may be utilized in any adaptive control implementation (or closed loop control strategy). For example, FIG. 2 depicts a control implementation 200 that employs a closed loop strategy. The implementation 200 includes a signal conditioning circuit 201 (or first circuit 201), a controller 202, a system or plant 204 (hereafter "plant 204") under the control of the controller 202, and a sensor 206. The signal conditioning circuit 201 may include a mixer 203 to separate a signal REFERENCE from a system/plant input signal and a pack circuit 209 to combine the signal REFERENCE with a signal MEASURED to provide a signal CONTROLLER_INPUT. It is recognized that all references to any signal herein may be singular or plural (e.g., any number of signals for each respective input and output). The signal REFERENCE may be provided to the signal conditioning circuit 201 via the mixer 203 and may be separated by the system/plant input signal or by a separate input to the signal conditioner circuit 201. The signal REFERENCE may directly correspond to audio output data that was previously output from the hardware layer 110 as illustrated in connection with FIG. 1. This may also be designated as a loopback mechanism. The signal REFERENCE may include data that is provided on any number of audio channels, M. The signal REFERENCE may correspond to audio data that is determined undesirable for a user. The signal MEASURED may also be provided to the signal conditioning circuit 201. The signal MEASURED may correspond to, for example, audio data that is transmitted from the sensor 206 (e.g., a microphone). The sensor 206 generates the signal MEASURED which corresponds to measured output from the plant 204 as also defined as a signal PLANT_OUTPUT from the plant 204. In this case, the signal MEASURED may correspond to the audio on signal PLANT_INPUT or CONTROLLER_OUTPUT. The signal MEASURED may include actual audio that is heard in a listening environment by a user. The signal MEASURED may include any number of audio channels, N. The controller 202 receives the signal CONTROLLER_INPUT which is a synchronized combination of the signal REFERENCE and the signal MEASURED from, for example, the sensor 206 (or microphone). It is recognized that an analog to digital converter may be positioned between the sensor 206 and the signal conditioning circuit 201. In general, the pack circuit 209 may merge data between the signal MEASURED and the signal REFERENCE. In one example, a merge operation may correspond to the pack circuit 209 adding or subtracting the signal MEASURED from the signal REFERENCE to provide a combined signal CONTROLLER_INPUT to the controller 202. The signal CONTROLLER_INPUT may be in the form of M channels, since the signal REFERENCE is superimposed on the signal MEASURED. Alternatively, the merge operation may correspond to the pack circuit 209 to combine (or pack) the signal MEASURED with the signal REFERENCE to provide the signal CONTROLLER_INPUT. However, as a result of the pack operation, the signal CONTROLLER_INPUT may be in the form of M+N channels, since the signal REFERENCE and the signal MEASURED is packed into individual slots of the signal CONTROLLER_INPUT. For example, the signal CONTROLLER_INPUT may form M+N audio-based channels that provide a Time Division Multiplexing (TDM) data stream and is packed with M audio-based channels from the signal MEASURED and N audio-based channels from signal REFERENCE. In general, the signal conditioning circuit 201 is configured to merge the data on the signal REFERENCE with the data on the signal MEASURED to provide a combined system data stream to the SoC device 111 to prevent temporal misalignment between the data on the signal REFERENCE and the data on the signal MEASURED. Such a temporal misalignment may be caused by one or more of the layers 102, 104, 106, and 108 during operation of the control implementation 200. This aspect will be discussed in more detail below.

As noted above, embodiments herein may be applied to any system, not including an audio system whereby it is desired to reduce temporal misalignment between two signals that propagate through one or more software layers of the Linux system. In an adaptive control system, the signal REFERENCE may simply correspond to input data to the plant which utilizes loopback mechanism. The signal MEASURED may correspond to data as provided by a sensor in the adaptive control system where the sensor provides some form of feedback information. Thus, in this case the signal conditioning circuit 201 may merge the data on the signal REFERENCE with the data on the signal MEASURED. After merging the data between these signals, this signal conditioning circuit 201 provides a combined system data stream to the SoC device 111 to prevent temporal misalignment between the data on the signal REFERENCE and the data on the signal MEASURED. The temporal misalignment may generally be caused by one or more of the software layers 102, 104, 106, and 108. This aspect may achieve a control target by, for example, minimizing an error utilizing the relative synchronized signals REFERENCE AND MEASURED SIGNAL. It is recognized that the implementation as set forth herein may not be used solely for audio related purposes but may be used for any system that seeks to resolve or reduce temporal misalignment between two signals that propagate through software layers of the Linux system.

The controller 202 employs an adaptive control strategy to perform this process over and over based on the signal MEASURED and the signal REFERENCE to adapt the control implementation 200 toward the plant 204 in a desired manner. However, it is recognized that the controller 202 may not be fully capable of controlling the plant 204 to achieve the desired outcome due to inherent system errors or inconsistencies. The above noted adaptive control implementation 200 may be performed any number of times to provide a control action in an optimum manner which may require at least a relative stable latency and timing between the signal REFERENCE and MEASURED to ensure control stability and optimum performance for the plant 204 under control by the controller 202. Any dynamic time/latency misalignment issue between the signal MEASURED and the signal REFERENCE as distributed in, for example, the LINUX system 101 such as the example illustrated in FIG. 1, may cause the controller 202 (or the controller 112 as illustrated in FIG. 1) to drop performance or even cause instability. However, it is recognized that the controller 202 may not be fully capable of controlling the plant 204 to achieve the desired outcome due to inherent system (or plant) errors or inconsistencies.

Referring back to FIG. 1, the application layer 102 generally includes, for example, audio clients and related user programs that enable music playback. These audio clients may connect to sound-servers via audio streams. The server layer 104 (or sound server) may be software and manages the use of, and access to audio devices, for example, sound cards. The server layer 104 may commonly run as a background process for sink and source handling. The server layer 104 may be implemented as PulseAudio or an audio connection kit such as, for example, JACK. PulseAudio is generally a sound system for various operating systems. PulseAudio generally serves as a proxy for sound applications. In the event the server layer 104 is implemented for Pulse-Audio, it is recognized that the PulseAudio may be a sound server that is utilized in UBUNTU distributions that connects to lower software layers, such as for example, the kernel layer 108 (or the ASLA layer). PulseAudio provides server/client connectivity within the application layer 102. JACK may be included in any number of LINUX applications.

The sound system layer 106 generally includes software to provide libraries for ALSA and OSS based on whether the ALSA or the OSS is utilized for implementation. The kernel or driver layer 108 may include sound drivers and sound devices. In the event the kernel layer 108 is utilized in connection with ALSA, the ALSA kernel layer 108 may support multichannel audio interfaces and provide application programming interface (API) access on managing hardware controls. ALSA may be a standard software layer within the multiprocessor LINUX based embedded systems to manage all audio streams and stream mixing including buffer handling between audio-hardware-peripherals and upper application-layers. In the event the kernel layer 108 is utilized in connection with OSS, the OSS kernel layer 108 includes LINUX kernel sound drivers and sound devices and connects the application layer with 102 with real audio-hardware-peripherals.

The system 100 further includes hardware-based input device(s) 120 that provide an input signal to the hardware layer 110. The input devices 120 may include any number of sensors such as microphones, acceleration sensor, etc. The system 100 further includes hardware-based output devices 122 that receive an output signal from the hardware layer 110. In one example, the hardware-based output devices 122 may include at least one controller for an audio system such as an acoustic echo cancellation (AEC), an active noise cancelation (ANC) system, etc. In general, as the system 100 receives an input signal from the input device 120 and the input signal propagates its way through the hardware layer 110, the kernel layer 108, the sound-subsystem layer 106, and the server layer 104, the processing performed by the controller 112 to execute such layers 102, 104, 106, and 108, the sound-subsystem layer 106, and the server layer 104 may cause latency issues with respect to the different and separated input streams of data that are processed by the system 100.

The application layer 102 generally includes a controller unit 124 that may utilize the signals REFERENCE and MEASURED independently of one another. For example, the signals REFERENCE and MEASURED each include individual and separate data from one another (e.g, the data between each signal is packed or added together (i.e., merged together). For example, the inputs to the controller unit 124 generally corresponds to the signal MEASURED as provided by the sensor 206 and the signal REFERENCE signal as set forth in FIG. 2. However, in this case, the system 100 does not employ the signal conditioning circuit 201 as set forth in FIG. 2. In this case, the system 100 buffers the signals REFERENCE and MEASURED as separate data streams. Hence, individual buffering of the signal MEASURED and REFERENCE in FIG. 1, at the various layers 102, 104, 106, and 108 (i.e., the dynamic buffer size modifications) may cause these individual signals to be misaligned or unsynchronized with one another. While the layer 110 may be hardware based, this layer 110 may not add to the latency issue between the signals REFERENCE and MEASURED.

However, notice that the stream of data on the signal Controller Output or Plant Input is processed by the layers 102, 104, 106, 108 and 110 in a downstream manner and that such a signal may completely or partly be loopback for upstream processing as the signal REFERENCE. Further, notice that the layers 102, 104, 106, and 108 process the signals MEASURED and REFERENCE in an upstream manner. Given that, the signal REFERENCE may be based on the signal Controller Output or Plant Input, this may add to the misalignment or non-synchronization as noted above. In general, the hardware layer 110 may include programmable sub-units and is generally defined as hardware in the LINUX system. The latency noted above may cause the hardware layer 110, although programmable, to be deterministic and static. The kernel layer 108 along with all of the layers above the layer 106 may software-based layers and the latency attributed to such layers 102, 104, 106, 108 may be assumed to be dynamic and not static (or deterministic due to Operating System (OS) setup within such layers 102, 104, 106, 108.

In general, the data provided by the hardware-based input device 120 may be digital. The hardware-based input devices 120 may include any number of analog to digital converters to provide the digital data on the signal MEASURED and within some controller applications as e.g. ANC would also provide the signal REFERENCE, as here the signal REFERENCE is not deviated from the signal Controller Output or Plant Input, but still requires the signal conditioner circuit 201 to add or pack the signal REFERENCE and MEASURED together into the combined signal Controller Input and forward that signal to the various layers 110, 108, 106, and 104 upstream for processing (see e.g., FIG. 5). Likewise, the data transmitted from the hardware-based output devices 122 may be digital. The hardware-based output devices 122 may include any number of digital to analog converters (DACs) to convert the digital data back to analog data.

Figure 3:
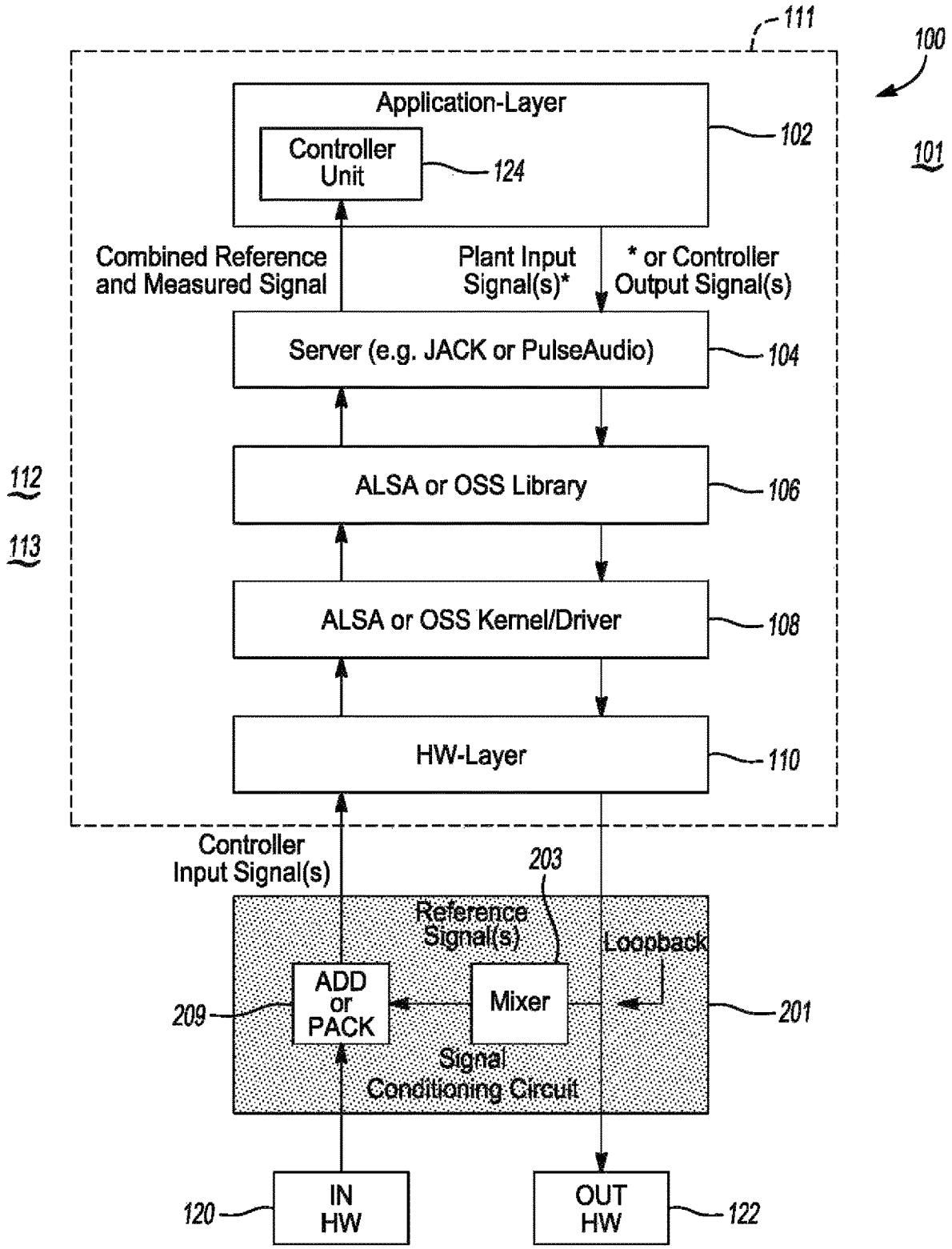
FIG. 3 depicts an embedded adaptive control system in accordance to one embodiment.

FIG. 3 depicts an embedded adaptive control system 100' in accordance to one embodiment. It is recognized that the system 100' may be implemented in a mobile device (not shown) such as for example a cellular phone (or in any other device that enables cellular communication), laptop, tablet, etc. The system 100' may be implemented in an audio processing device of the mobile device. The system 100 generally includes the signal conditioning circuit 201 that is positioned intermediate to the hardware layer 110 and to the hardware-based input device(s) 120 and the hardware-based output device(s) 122. As noted above, the input device(s) 120 may correspond to a microphone or acceleration sensor, which provides measured audio data from a listening environment (e.g., see signal MEASURED from FIG. 2). As also noted above, the hardware-based output devices 122 may include the power amplifier in addition to any number of D/A converters for converting the digital data on the signal Controller Output or Plant Input to analog data and to provide the same to any loudspeakers in the room or listening environment. As noted above, signal REFERENCE may fully or partly correspond to the signal Controller Output or Plant Input. In addition, the hardware-based output devices 122 may also include at least one controller for an audio system such as an acoustic echo cancelation (AEC), an active noise cancelation (ANC) system, etc. The signal conditioning circuit 201 may be a Field-Programmable Gate Array (FGPA), an Application-Specific Integrated Circuit (ASIC), a digital signal processor (DSP), etc. Similarly to the signal conditioning circuit 201 of FIG. 2, the signal conditioning circuit 201 as illustrated in FIG. 3 may also include the mixer 203 and pack circuit 209 to combine the signals REFERENCE and MEASURED to provide a combined Controller Input data stream. As shown in FIG. 3, the combined system data stream may be referred to as signal COMBINED REFERENCE AND MEASURED SIGNAL(S). As noted above, the signal REFERENCE may be utilized fully or may be partly deviated (or originated) from the signal CONTROLLER_OUTPUT or PLANT_INPUT but not shown in FIG. 2.

As noted above, the layers 102, 104, 106, and 108 may be software-based layers and may be considered non-deterministic (or time-varying). Therefore, such layers 102, 104, 106, and 108, when executed by the controller 112, may generally contribute to causing misalignment between the signals REFERENCE and MEASURED due to dynamic buffer size modifications and/or processing latencies. However, given that the signal conditioning circuit 201 (e.g., the mixer 203 and/or the pack circuit 209) is hardware based and time deterministic, the signal conditioning circuit 201 is generally applied or positioned before all of the non-time deterministic (or time varying) layers 102, 104, 106, and 108 which may mitigate any misalignment between the signals REFERENCE and MEASURED as both signal are combined with one another via the signal conditioning circuit 201 to provide the signal COMBINED REFERENCE AND MEASURED called the signal CONTROLLER_INPUT.

For example, the typical dynamic buffer size modification between the layers 102, 104, 106, and 108 may change the overall end-to-end latency. However, the signal conditioning circuit 201 may synchronize the signals REFERENCE AND MEASURED since the position of the signal conditioning circuit 201 is positioned beyond the potential dynamic buffer latency modification related to SW layer processing, the latency of the signals COMBINED REFERENCE AND MEASURED may be considered constant. For example, any latency applied to the signal COMBINED REFERENCE AND MEASURED may affect the signals REFERENCE and MEASURED in the same manner and therefore the relative latency can be considered as constant. The signals REFERENCE and MEASURED when present in the signal COMBINED REFERENCE AND MEASURED may correspond to the signals REFERENCE and MEASURED as set forth in FIG. 2. The same may hold true for the signal COMBINED REFERENCE AND MEASURED which may correspond to the signal CONTROLLER_INPUT as set forth in FIG. 2. The signal conditioning circuit 201 (via the pack circuit or the mixer) merges or combines the signals REFERENCE and MEASURED with one another to provide a combined system input (or combined system data stream) to the SoC device 111 to prevent any temporal misalignment within one or more of the non-deterministic software layers 102, 104, 106, and 108 during device operation.

Figure 4:
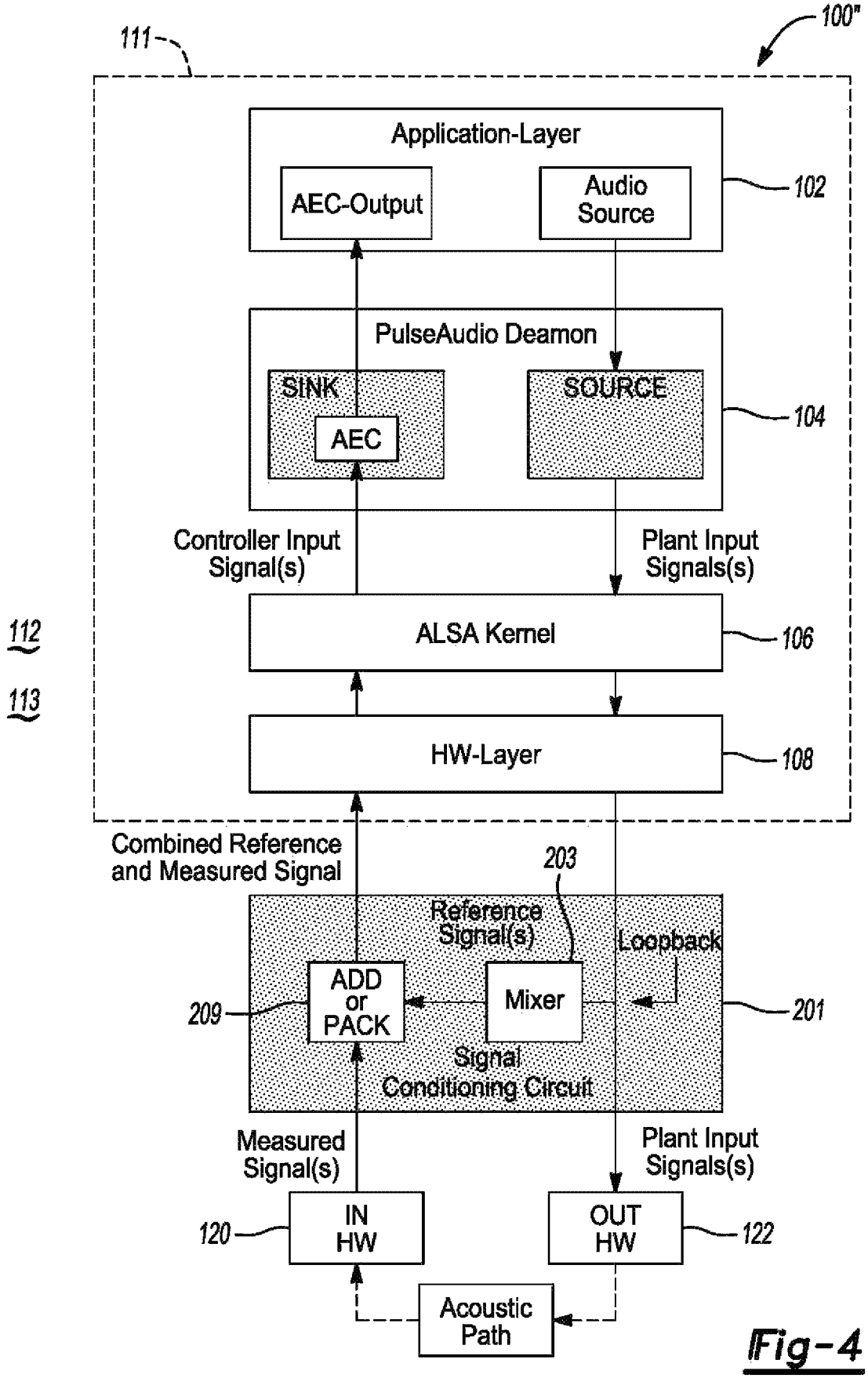
FIG. 4 depicts an example of a detailed implementation of the adaptive control system as used in connection with an Acoustic Echo Canceler/Cancellation in accordance to one embodiment.

FIG. 4 depicts an example of an adaptive control system 100" as used in connection with an AEC system in accordance to one embodiment. The server layer 104 (or Pulse-Audio Daemon) generally includes a sink layer 300 and a source layer 302. The adaptive control system 100" generally illustrates the case of independent sink and source processing embedded into a typical pulse audio daemon framework. The pulse audio I/O buffer of the server layer 104 cannot be assumed to be synchronized.

The hardware-based input device(s) 120 may provide audio data on signal MEASURED as captured from a microphone or acceleration sensor (not shown) as used in connection with the AEC system. The captured audio data may correspond to desired voice data but including undesired echo data that is captured in a room or listening environment (e.g., data on the signal MEASURED). The signal conditioning circuit 201 may forward the audio data from the signal SYSTEM_INPUT and provide the same to the hardware-based output device(s) 122 to be broadcasted to the acoustic path, which is representing the plant 204 as shown in FIG. 2. As noted above, the signal REFERENCE may correspond to the signal SYSTEM_INPUT. In case of AEC, the audio data on the signal SYSTEM_INPUT may correspond to music data that is played back independent of the controller operation but is considered as the undesired echo once forward to the system or plant during playback. The signal conditioning circuit 201 may fully or partly mix the signal SYSTEM_INPUT as signal REFERENCE and combine this with the signal MEASURED to allow echo cancelation within the controller. It is recognized that the hardware-based output device(s) 122 may include a power amplifier in addition to any number of D/A converters for converting the digital data on the signal SYSTEM_INPUT to analog data and to provide the same to any loudspeakers in the room or listening environment.

The signal conditioning circuit 201 may, in real time, pack or add data on the signal REFERENCE with the measured microphone data (i.e., desired voice with undesired echo) on the signal MEASURED to provide the signal COMBINED REFERENCE AND MEASURED or signal CONTROLLER_INPUT. The signal COMBINED REFERENCE AND MEASURED or signal CONTROLLER_INPUT may be considered robust against any dynamic system behavior, as the latency between microphone data and reference data may stay relatively constant on the signal COMBINED REFERENCE AND MEASURED or signal CONTROLLER_INPUT. Although the input/output (I/O) end-to-end latency may dynamically change, the AEC convergence may be guaranteed due to the stable/constant relative latency between the microphone data and reference data on the signal COMBINED REFERENCE AND MEASURED.

Figure 5:
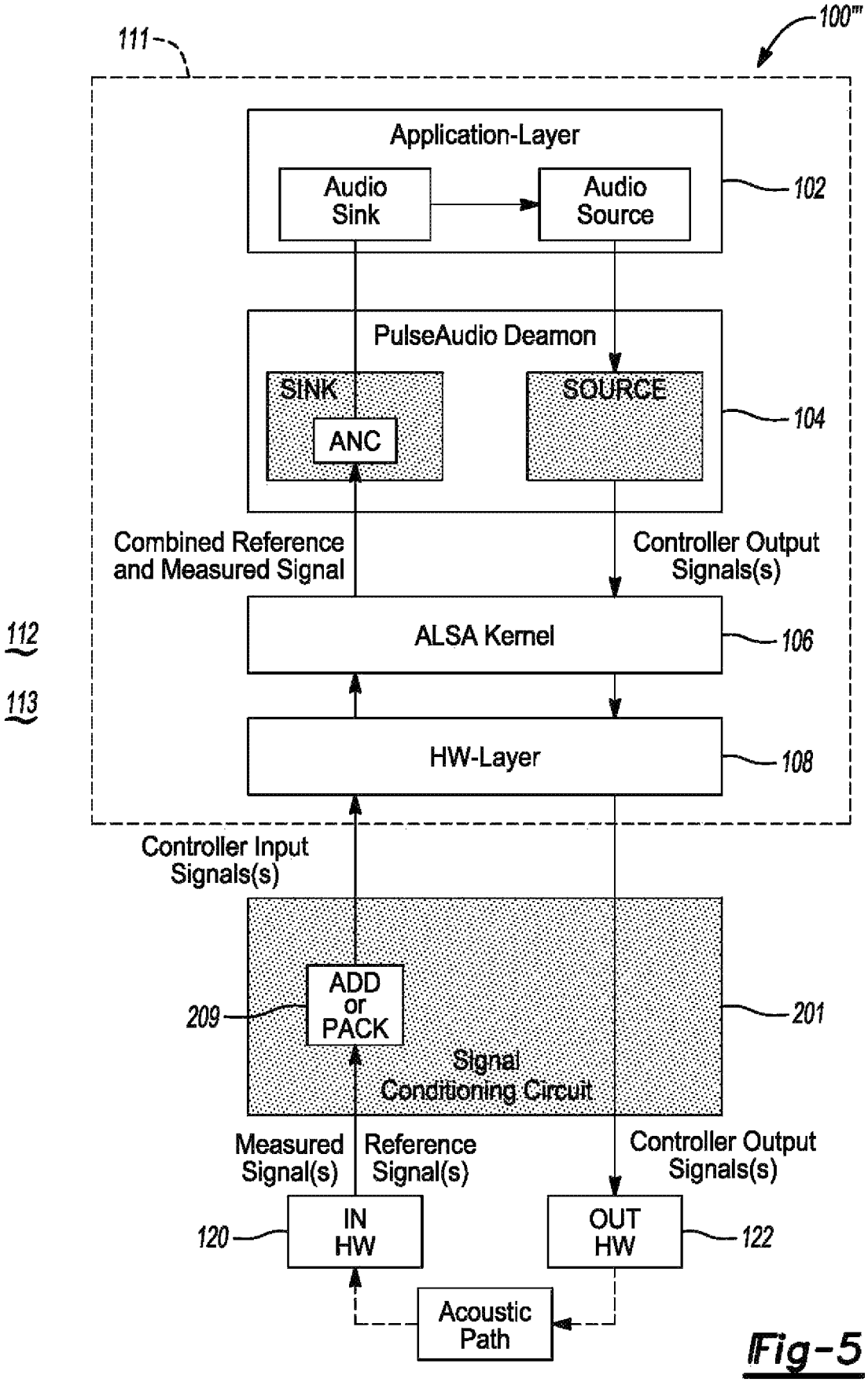
FIG. 5 depicts an example of a detailed implementation of the adaptive control system as used in connection with an Active Noise Cancellation in accordance to one embodiment.

FIG. 5 depicts an example of an adaptive control system 100''' as used in connection with an ANC system in accordance to one embodiment. The server layer 104 (or Pulse-Audio Daemon) generally includes a sink layer 300 and a source layer 302. The adaptive control system 100''' generally illustrates the case of independent sink and source processing embedded into a typical pulse audio daemon framework. The pulse audio I/O buffer of the server layer 104 may not be assumed to be synchronized.

The hardware-based input device(s) 120 may provide audio data on the signal MEASURED as captured from a microphone or acceleration sensor (not shown) as used in connection with the ANC system. The captured audio data may correspond to undesired noise along with desired music or voice data that is captured in a room or listening environment (e.g., data on the signal MEASURED). The signal conditioning circuit 201 may forward the audio data from the signal CONTROLLER_OUTPUT and provide the same to the hardware-based output device(s) 122 to be broadcasted to the acoustic path for noise cancelation, which is representing the plant as shown in FIG. 2. As noted above, the signal REFERENCE may not correspond to the signal CONTROLLER_OUTPUT but may correspond to only undesired noise as provided by another sensor that provides only undesired noise, which is not illustrated in FIG. 2. In case of ANC, the audio data on the signal CONTROLLER_OUTPUT may correspond to anti-noise data that is serves as a loopback via the controller operation within application layer 102 toward the audio source in order to playback anti-noise signals for noise cancelation through the plant 204. The signal conditioning circuit 201 merges the signal REFERENCE with the signal MEASURED to allow noise cancelation by the controller via the plant 204. It is recognized that the hardware-based output device(s) 122 may include a power amplifier in addition to any number of D/A converters for converting the digital data on the signal CONTROLLER_OUTPUT to analog data and to provide the same to any loudspeakers in the room or listening environment.

The signal conditioning circuit 201 may, in real time, pack or add data (i.e., merge data) on the signal REFERENCE with the measured microphone data (i.e., desired music/voice with undesired noise) on the signal MEASURED to provide the signal COMBINED REFERENCE AND MEASURED or signal CONTROLLER_INPUT. The signal COMBINED REFERENCE AND MEASURED or signal CONTROLLER_INPUT may be considered robust against any dynamic system behavior, as the latency between microphone data and reference data may stay relatively constant on the signal COMBINED REFERENCE AND MEASURED or signal CONTROLLER_INPUT. Although the input/output (I/O) end-to-end latency may dynamically change, the ANC convergence may be guaranteed due to the stable/constant relative latency between the microphone data and reference data on the signal COMBINED REFERENCE AND MEASURED.

The data streams that correspond to signals MEASURED, REFERENCE, COMBINED REFERENCE AND MEASURED, CONTROLLER_INPUT, PLANT_INPUT and CONTROLLER_OUTPUT may be implemented as Time Division Multiplex (TDM) data streams or internal linear or ring buffers between the software layers 102, 104, 106. For the example noted in connection with FIG. 4 above, the TDM data streams are partly filled with the input data (e.g., audio data from the measured microphone), output data (e.g., data from the signal CONTROLLER_OUTPUT) and the data from the signal REFERENCE. In the example as noted in connection with the system 100", the TDM based data streams may be packed with 1 to N+M channels (or bits of data), where M corresponds to the audio data from the measured microphone (or from the hardware-based input device(s) 120) and N corresponds to reference data. In the case of AEC, the microphone content may include desired voice and undesired echo after the AEC controller processes the echo ideally is fully canceled and the voice is treated as SINK for further application services. In general, the music may serve as a SOURCE (device transceiver music). The voice may serve as a SINK since the device receives the voice for communication propose, as e.g. telephone calls. In the case of ANC, the microphone content may include desired music/voice and undesired noise after the ANC controller processes the noise ideally is fully canceled and the anti-noise signal is treated as SINK for the audio SOURCE application, so the controller anti-noise signal can loopback to the device output and perform the noise cancelation within the acoustic path.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An embedded Linux system for an audio processing device, the system comprising:

a memory;

a system on a chip (SoC) device including the memory and being programmed to process at least a reference signal indicative of undesired audio content and a measured signal indicative of measured audio data in a listening environment; and a first circuit being programmed to:

receive the reference signal;

receive the measured signal; and merge the reference signal with the measured signal to provide a combined system input to a hardware layer of the SoC device prior to the combined system input being received at a plurality of software layers of the Linux system to prevent temporal misalignment between the reference signal and the measured signal caused by the plurality of software layers of the Linux system.

2. The system of claim 1 further comprising a mixer programmed to transmit the reference signal to the first circuit.

3. The system of claim 1 further comprising an input sensor programmed to transmit the reference signal to the first circuit.

4. The system of claim 1 further comprising an input sensor programmed to transmit the measured signal to the first circuit.

5. The system of claim 4, wherein the input sensor is one of a microphone or an acceleration sensor.

6. The system of claim 1, wherein the first circuit is further programmed to merge the reference signal with the measured signal prior to the combined system input being transmitted to the plurality of software layers of the Linux system.

7. The system of claim 1, wherein:

a first software layer of the plurality of software layers includes at least one audio-based kernel, the at least one audio-based kernel includes a sound driver;

a second software layer of the plurality of software layers includes an audio-based library; and a third software layer of the plurality of software layers includes a sound server to manage sound cards.

8. The system of claim 1, wherein the first circuit is further programmed to receive the reference signal as a plurality of N audio-based channels.

9. The system of claim 8, wherein the first circuit is further programmed to receive the measured signal as a plurality of M audio-based channels.

10. The system of claim 9, wherein the first circuit is further programmed to merge the reference signal with the measured signal to generate M+N audio-based channels to form a Time Division Multiplexing (TDM) data stream.

11. A computer-program product embodied in a non-transitory computer readable medium that is programmed to prevent temporally misalignment between a reference signal and a measured signal for an embedded Linux system, the computer-program product comprising instructions to:

receive the reference signal that is indicative of undesired audio content;

receive the measured signal that is indicative of measured audio data in a listening environment;

process the reference signal and the measured signal at a system on a chip (SoC) device; and merge the reference signal with the measured signal to provide a combined system input to a hardware layer of the SoC device prior to the combined system input being received at a plurality of software layers of the Linux system to prevent temporal misalignment between the reference signal and the measured signal caused by the plurality of software layers of the Linux system.

12. The computer-program product of claim 11 further comprising instructions to transmit the reference signal to the first circuit via a mixer.

13. The computer-program product of claim 11 further comprising instructions to transmit the reference signal to the first circuit via an input sensor.

14. The computer-program product of claim 11 further comprising instructions to transmit to transmit the measured signal to the first circuit.

15. The computer-program product of claim 11 further comprising instructions to merge the reference signal with the measured signal prior to the combined system input being transmitted to the plurality of software layers of the Linux system.

16. The computer-program product of claim 11, wherein a first software layer of the plurality of software layers includes at least one audio-based kernel, the at least one audio-based kernel includes a sound driver;

a second software layer of the plurality of software layers includes an audio-based library; and a third software layer of the plurality of software layers includes a sound server to manage sound cards.

17. The computer-program product of claim 11 further comprising instructions to receive the reference signal as a plurality of N audio-based channels.

18. The computer-program product of claim 17 further comprising instructions to receive the measured signal as a plurality of M audio-based channels.

19. The computer-program product of claim 18 further comprising instructions to pack or add/merge the reference signal with the measured signal to generate an M+N audio-based channels to form a Time Division Multiplexing (TDM) data stream.

20. A computer-program product embodied in a non-transitory computer readable medium that is programmed to prevent temporally misalignment between a reference signal and a measured signal for an embedded Linux system, the computer-program product comprising instructions to:

receive the reference signal that is indicative of output data for an adaptive control system;

receive the measured signal;

process the reference signal and the measured signal at a system on a chip (SoC) device; and merge the reference signal with the measured signal to provide a combined system input to a hardware layer of the SoC device prior to the combined system input being received at a plurality of software layers of the Linux system to prevent temporal misalignment between the reference signal and the measured signal caused by the plurality of software layers of the Linux system.

* * * * *